United States Patent [19]

Niina

[11] 4,120,496

[45] Oct. 17, 1978

[54] GOLF CUP WITH SOUND PRODUCING DEVICE

[76] Inventor: Yozo Niina, No. 562, Tozinmachi, Usuki City, Oita Prefecture, Japan

[21] Appl. No.: 773,558

[22] Filed: Mar. 2, 1977

[30] Foreign Application Priority Data

Mar. 5, 1976 [JP] Japan ..... 51-23089

[51] Int. Cl.[2] ..... A63B 57/00; A63B 69/36; G11B 15/00

[52] U.S. Cl. ..... 273/34 R; 273/184 A; 46/175 R; 340/323 R

[58] Field of Search ..... 273/176 FA, 179 A, 181 C, 273/181 E, 185 R, 34 R, 178 R, 179 R, 177 R, 184 A, 184 R

[56] References Cited

U.S. PATENT DOCUMENTS

| | | | |
|---|---|---|---|
| 1,678,573 | 7/1928 | Nakashima | 273/176 FA |
| 3,575,559 | 4/1971 | Tierney | 273/176 FA X |
| 3,874,665 | 4/1975 | McCulloch | 273/179 A X |

*Primary Examiner*—George J. Marlo

[57] ABSTRACT

A golf cup with a sound producing device therein mounted on a projection projecting upwardly from the bottom of the golf cup and with a hollow center forming a flagstick base receiving hole. The top of the circuit box for the device is a metal contact with an annular sponge thereon having a plurality of apertures therein extending through the thickness of the sponge. A metal contact plate is positioned on the top surface of the sponge and has a plurality of projections on the under side of the contact plate projecting into the apertures in the sponge and having the free ends spaced from the top when the sponge is in the uncompressed condition and contacting the top when said sponge is compressed when struck by a golf ball falling into the cup. A sound producing circuit within said circuit box has the top and the contact plate coupled therein as an actuating switch. A twittering or chirping sound is produced by the sound producing device to harmonize with the natural atmosphere of a golf course.

2 Claims, 6 Drawing Figures

GOLF CUP WITH SOUND PRODUCING DEVICE

As everybody knows, the electrically produced sounds are widely used, for example, music to indicate ringing of a telephone, as a time indicator in a clock or an indicator in a door bell. But these sounds are all chime sounds. It is the object of the invention to producing similarly natural sounds, especially twittering. To achieve this purpose, the sound producing means of this invention is provided in a golf hole and it produces a sound by means of an electric circuit. In the hole, there is a cylinder comprising a lid in the form of a terminal plate and a circuit box set in the pipe, the terminal plate being able to be separated from the box. The electric circuit is inserted in the box and connected to the terminal plate. A dry cell serves as a source of electric energy and a loudspeaker is connected with the terminal plate and other parts of the electric circuit, and the circuit, the dry cell and the speaker are provided in the inside bottom of the pipe. Through the said loudspeaker, the electric circuit produces said natural sound.

DETAILED DESCRIPTION

Figure 1:
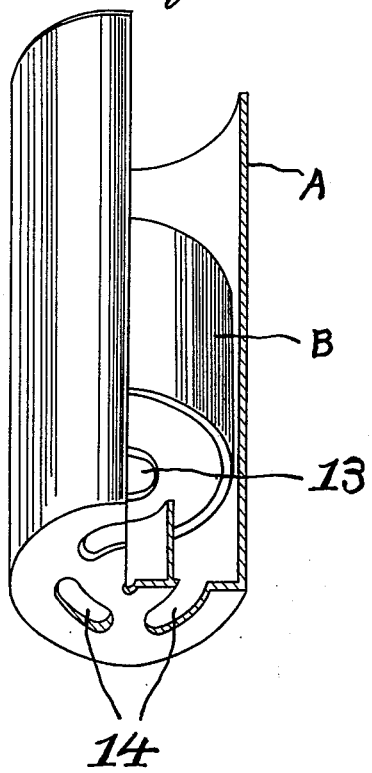
FIG. 1 is a partially cut away perspective view of a golf hole having the sound producing means therein.
Figure 2:
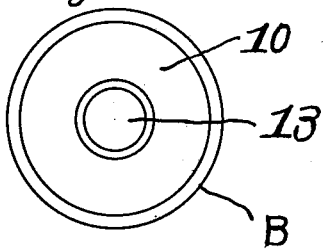
FIG. 2 is a plan view of the terminal plate on the circuit box.
Figure 3:
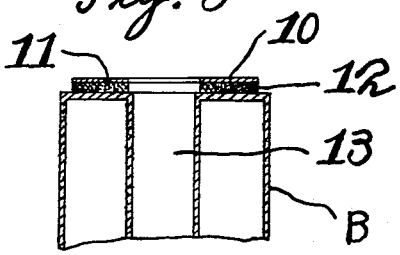
FIG. 3 is a partial view, in section, of the terminal plate on the circuit box.
Figure 4:
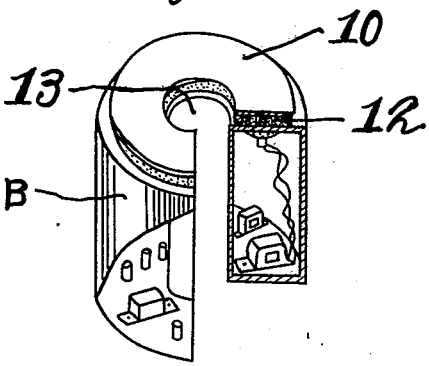
FIG. 4 is a perspective view, partially cut way of the circuit box.

As seen in FIGS. 1–4, a conventional golf cup A having drainage holes 14 in the bottom thereof has a cylindrical circuit box B mounted on a projection a in the bottom thereof, the cylindrical circuit box having a central hole 13 therein to receive the base of a flagstick therein. The annular top of the circuit box B is a metal contact connected to one side of a power supply, described hereinafter, of a sound producing circuit, and has an annular sponge 12 thereon with apertures 12*a* therein. A terminal plate 10 is mounted on the upper surface of the annular sponge 12 and has a pluraity of projections 11 on the under side of the terminal plate which in the normal uncompressed condition of the sponge are spaced from the annular top of the circuit box B. The terminal plate is connected to the sound producing circuit in a manner to be described so that when the terminal plate is depressed to cause the contacts 11 to touch the top of the circuit box B, a circuit is completed between the terminal plate and the top of the box.

Figure 5:
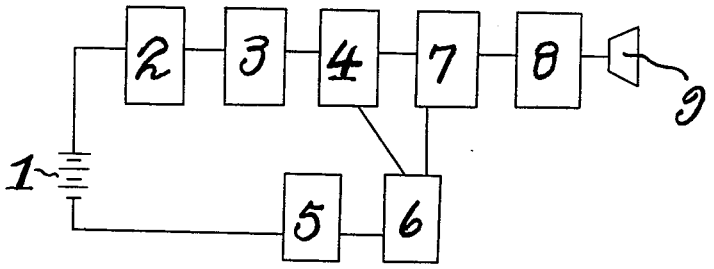
FIG. 5 is a block diagram of the sound producing circuit.
Figure 6:
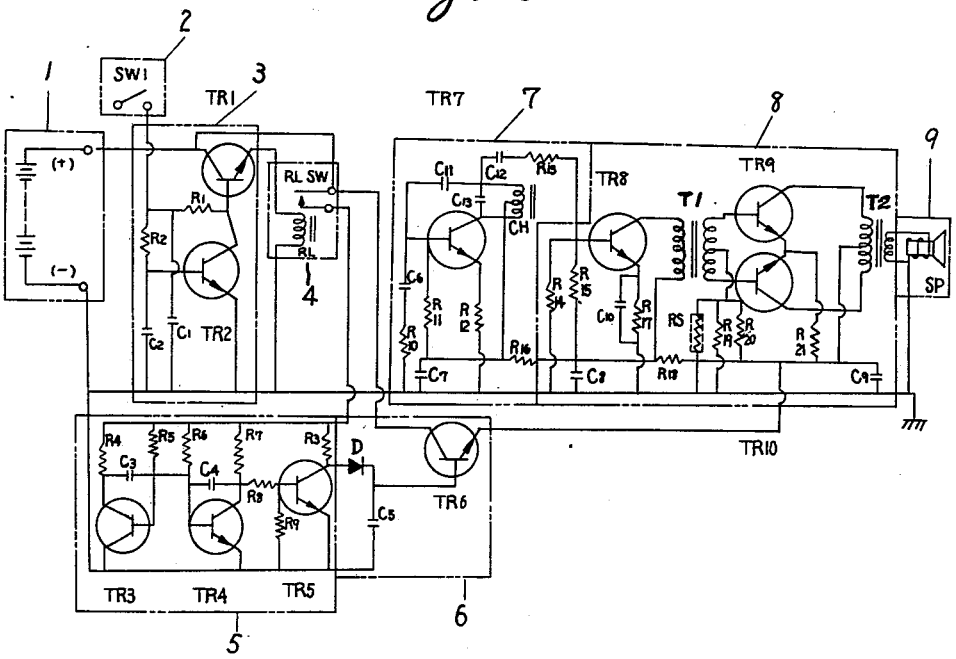
FIG. 6 is a detailed circuit diagram of the sound producing circuit.

The electric circuit is illustrated schematically in FIG. 5 and in detail in FIG. 6. A source of electric energy 1 is connected directly and through a switch 2 to a relay unit 3 having transistors TR1 and TR2 connected in a circuit to maintain the relay actuating unit on for a time required regardless of the length of time SW1 is closed, and 4 is the relay switch (RLSW) which closes and opens depending on the collector current of the transistor TR1. A square wave oscillating circuit 5 having transistors TR3 and TR4 is provided to select the capacity of a capacitor C3 or C4 so that it can suitably change the wavelength and determine the positive and negative percentage of one cycle. A control circuit 6 is provided having transistors TR5 and TR6, transistor TR5 being a buffer amplifier, since the voltage variation of the transistor TR4 are not sufficiently strong to control the transistor TR6. A secondary oscillator 7 is provided to oscillate the sound wave at intervals by controlling the base TR7 by the discharge and the charge of capacitor C6. A low-frequency amplifier circuit 8 is provided to transmit the sound wave produced by oscillators 5 and 7 and mix and amplify it by transistors TR8, TR9 and TR10 and supply it to a loudspeaker 9. TR8 is an A-class amplifier, and TR9 and TR10 are B-class amplifiers the final output power of which is 0.3W.

The electrical action of the said electric circuit is as follows. When a golf ball is holed, it collides with plate 10 on the circuit box B which is connected to one side of the circuit of FIG. 6 as one contact of switch SW1. The top of the circuit box B is connected as the other contact of switch SW1. With sponge 12 between the terminal plate 10 and the circuit box positioned in the cup, these projections are not in contact with the terminal formed by the top of the circuit box when a golf ball has not collided with the terminal plate 10. In this condition, the circuit is broken, i.e. the switch SW1 is open. Because the said sponge contracts due to the impulse of the ball when the ball collides with the terminal plate, the terminal plate goes down and the projections are contacted with the circuit box. This acts as a closing of the switch SW1 of the circuit which is in the box. The current coming from the dry cell 1 charges the condenser C1 and together with passing the resistance R1, it supplys the base voltage to the transistor TR1 to pass a collector current, which acts upon the relay RL to energize it and close the interlocking switch RLSW. Even though switch SW1 opens quickly, current continues to flow for a predetermined time, for example for 4.5 seconds, because the charge current charged in capacitor C1 discharges gradually and continues to act as the base voltage of TR1 after passing the resistance R1 and the absorption in R2 continues. When RLSW closes, electric energy is supplied to the square wave oscillator 5. This circuit produces a well-balanced square wave, in which the positive phase and the negative phase are in the ratio 3:7. By amplifying the positive-phase of the square wave with the transistor TR5, transistor TR6 is driven. Therefore, when there is no output voltage from transistor TR5, transistor TR6 does not operate and the emitter voltage becomes zero. However, when current to the base of TR6 is supplied from capacitor C5, transistor TR6 stops working slowly and, the emitter voltage of TR6 drops slowly. The diode D acts to impede the counter current for transistor TR5 so as to supply the current from C5 to TR6. Transistor TR7 in the circuit 7 causes the circuit to act as a feedback oscillating circuit, in which as the oscillation is produced by the charging and discharging of C6, an intermittent wave is produced. On the other hand, because the oscillation frequency of transistor TR7 changes with the variation of the output voltage of transistor TR6, the intermittent oscillation together with the variation of the frequency produces a double variation of the sound. This circuit produces a sound such as twittering to harmonize with the natural atmosphere of the golf course. The frequency of this oscillation is determined by the capacity of capacitor C13 and when the base voltage of transistor TR7 which is supplied through R11 is used to charge capacitor C6, the current to the base of transistor TR7 drops and it ceases to produce oscillation. When the charging on capacitor C6 is complete, the base voltage of transistor TR7 again becomes sufficient to cause it to operate and it starts to oscillate. The cycle of periodic action can be controlled by the capacity of capacitor C6. Thus, there is achieved the object of producing a sound of 0.3W through the loudspeaker and amplifying the sound signal in the oscillation and amplification circuits 7 and 8.

I claim:

1. In combination, a golf cup having drainage holes in the bottom thereof, a projection projecting upwardly from the bottom of said golf cup, an annular circuit box on said projection, the hollow center of said circuit box being a flagstick base receiving hole, the top of said circuit box being a metal contact, an annular sponge on said top and having a plurality of apertures therein extending through the thickness of said sponge, a metal conact plate on the top surface of said sponge and having a plurality of projections on the under side of said contact plate projecting into said apertures in said sponge and having the free ends spaced from said top when the sponge is in the uncompressed condition and contacting said top when said sponge is compressed, and a sound producing circuit within said circuit box having an energy source and a sound producing means and said top and said contact plate being coupled in said sound producing circuit as an actuating switch for said sound producing circuit, said sound producing circuit having means for keeping the circuit energized for producing a sound for a predetermined time after the projections on said contact plate is moved into contact with said top, whereby when a golf ball falls into said golf cup and strikes said terminal plate, said sponge is compressed and said projections contact said top for energizing said sound producing circuit.

2. The combination as claimed in claim 1 in which said sound producing circuit comprises means for producing a twittering sound.

* * * * *